United States Patent [19]

Taylor

[11] 3,989,106

[45] Nov. 2, 1976

[54] SWAB DEVICE

[76] Inventor: William T. Taylor, 222 Camp Lilly Road, Humble, Tex. 77338

[22] Filed: June 4, 1975

[21] Appl. No.: 583,858

Related U.S. Application Data

[63] Continuation-in-part of Ser. No. 387,796, Aug. 13, 1973, abandoned.

[52] U.S. Cl. ..... 166/176; 166/202

[51] Int. Cl.[2] ..... E21B 37/02; E21B 33/00

[58] Field of Search ..... 166/121, 113, 135, 170, 166/171, 176, 177, 192, 212, 217, 202

[56] References Cited

UNITED STATES PATENTS

| | | | |
|---|---|---|---|
| 1,949,498 | 3/1934 | Stone et al. | 166/135 |
| 2,052,006 | 8/1936 | Taylor | 166/119 |
| 2,114,373 | 4/1938 | Edwards | 166/135 |
| 2,274,940 | 3/1942 | Stoddard | 166/121 |
| 2,460,481 | 2/1949 | Abel | 166/177 |
| 2,633,202 | 3/1953 | Hartsell | 166/121 |
| 2,739,652 | 3/1956 | Hartsell | 166/121 |
| 3,052,302 | 9/1962 | Lagucki | 166/170 |
| 3,294,173 | 12/1966 | Hodges | 166/121 |
| 3,378,069 | 4/1968 | Fields | 166/113 |
| R20,546 | 11/1937 | Otis | 166/121 |

*Primary Examiner*—James A. Leppink

[57] ABSTRACT

For use in oil tools which are adapted to be run travelling relatively upwardly or downwardly in drill pipe for removing mud in the drill pipe, an improvement which incorporates a swab cup which flares out to contact the side wall of the pipe for the purpose of wiping it clean. It incorporates a rubber tubular body which is clamped in a slidable position on a support mandrel. The cylindrical body is tubular and concentric with the mandrel. The swab cup flares outwardly and has an exposed, external wiping lip. The external lip is shaped and dimensioned to contact the surrounding wall. This enables it to wipe the wall clean. The lip is connected to some elongate support members, typically straps which have a sizeable width which collectively extend from the lip to an encircling sliding collar. The collar slides along the support mandrel. The range of travel of the collar is limited by a shoulder preferably incorporated in the support mandrel. Variations in diameter of the pipe to be wiped are accomodated by the flexure of the straps and the lip. The straps pull the wiping lip inwardly when an internal upset is encountered in the pipe. The apparatus can be run with the wiping lip facing upwardly to support a column of mud. It can also be run inverted to wipe mud on the side wall downwardly and avoid dripping mud on the platform floor when the drill string is being disassembled, as in pulling a drill bit.

9 Claims, 5 Drawing Figures

FIG. 1
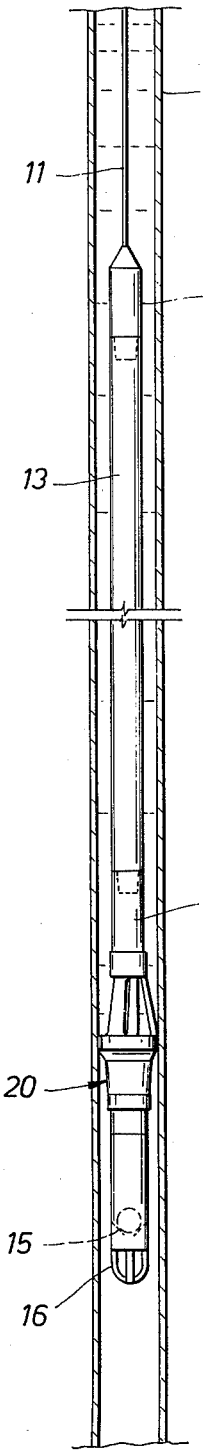
FIG. 2
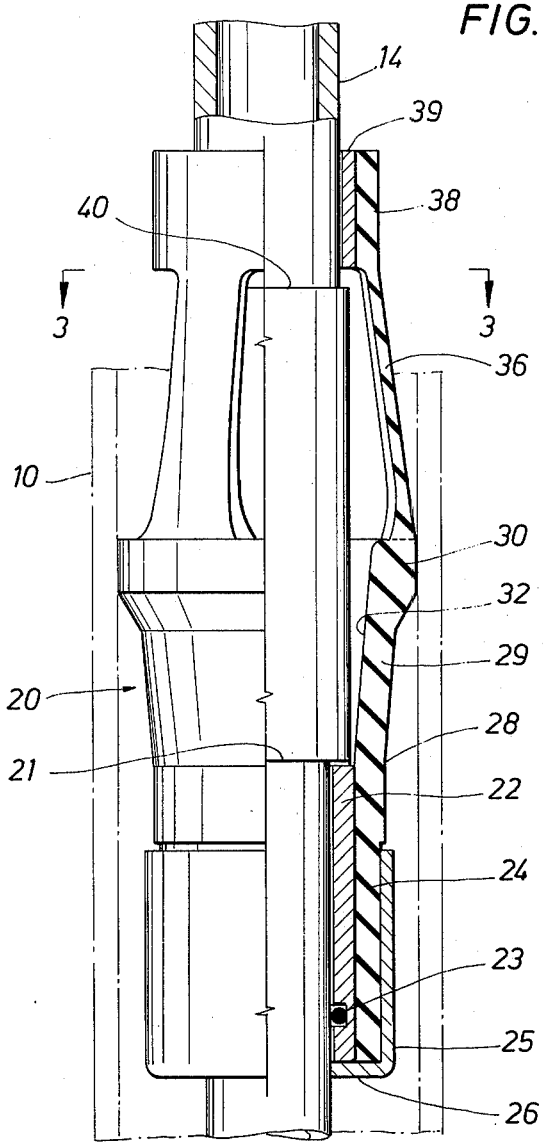
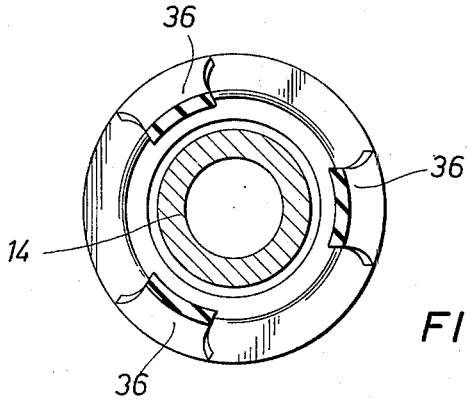
FIG. 3

SWAB DEVICE

RELATED APPLICATIONS

This application is a continuation-in-part of patent application Ser. No. 387,796, filed Aug. 13, 1973, by the same inventor now abandoned.

BACKGROUND OF THE INVENTION

In the parent application, an apparatus is disclosed which provides improved mud wiping in a tubing string. The apparatus shown in the referenced parent application is intended to wipe the mud clinging to the wall of a drill string when the drill string is pulled from the well. This typically occurs at the time a drill bit is changed. For example, the drill bit may wear out when the drill string is about 10,000 feet long. This necessitates pulling the drill pipe in stands of about ninety feet each. As each stand of pipe is pulled from the bore, the drill bit is pulled closer to the surface as the drill string is disassembled. Disassembly of the drill string above the rotary table, as is customary, results in spilling some mud on the floor from the stand of pipe just pulled from the well. The apparatus shown in the parent application is directed to a device which wipes the mud away from the wall and forces it downwardly. The device in effect floats on top of the column of mud standing in the drill string. As it is wiped away, the column falls relatively in the drill string. The drill string is pulled upwardly relative to the apparatus. The apparatus includes pressure responsive means which causes it to set in the event a blow-out is directed up the drill string.

The referenced disclosure includes various wiping elements. While they have met with some success, the improvement of the present disclosure clearly provides improved operation. The apparatus has a wiping lip which is opened downwardly to force mud under the lip, causing it to swell or expand. When it swells, it flares outwardly against the side wall of the surrounding pipe. This is good for internal flush drill pipe. Normally drill pipe is formed with reinforced couplings between joints. Each joint is assembled by threading together a pin and box. The pin and box are reinforced by fabrication of a coupling which has a thick construction. This forms an upset in the pipe which must be on the interior or exterior of the pipe. The upset is often placed on the exterior where it forms no problem. However, internal upset pipe presents some problems in clean wiping. The apparatus of the present invention overcomes problems with wiping the interior of a pipe when there are internal upsets.

SUMMARY OF THE INVENTION

The present invention is a rubber swab adapted to be positioned on a support mandrel and which can be run in a pipe either facing upwardly or downwardly. The apparatus includes a first tubular portion which fits about the support mandrel. It is preferably anchored. A metal spool fits around it and clamps or holds the rubber in place. It is in the form of a right cylinder and flares outwardly at one end to a wiping lip. A space is defined beneath the wiping lip for receiving mud as it flares outwardly. The wiping lip extends to the wall of the drill pipe and is connected to two or three straps of fairly wide construction which extend therefrom toward a resilient ring mounted about the support mandrel. The ring slides, thereby flaring the wiping lip. When an upset is encountered from either direction, the wiping lip shrinks in size and passes through the restriction in the pipe. The straps which are attached to it prevent the lip from doubling back when an internal upset is encountered.

DESCRIPTION OF THE DRAWINGS

FIG. 1 shows the wiping cup installed on a weighted mandrel for picking up a column of mud or other fluid in a well bore where the apparatus is lifted on a wireline, the wiping cup supporting a column of mud;

FIG. 2 is an enlarged view of the wiping cup, partly in section, showing details of construction;

FIG. 3 is a sectional view along the line 3 — 3 of FIG. 2 showing details of construction of the straps and rings which are connected to the wiping cup;

DESCRIPTION OF THE PREFERRED EMBODIMENT

Figure 4:
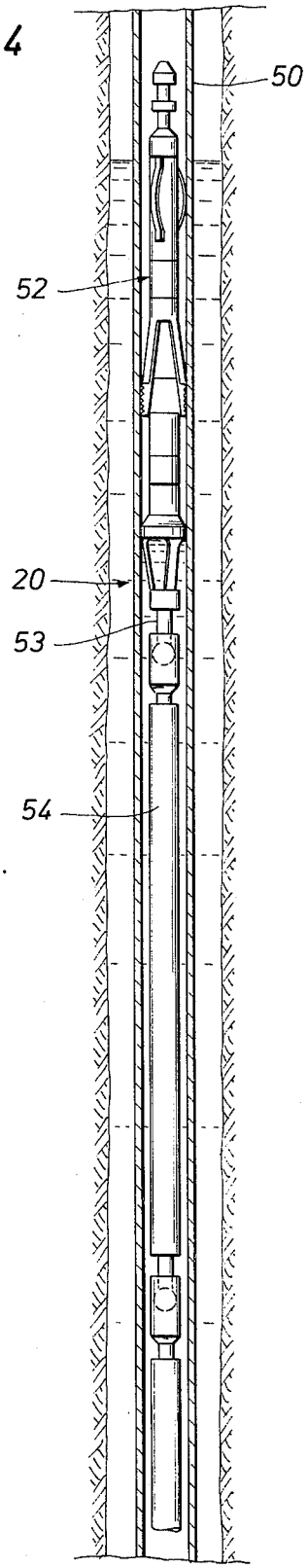
FIG. 4 is a elongate sectional view showing the wiping cup inverted in comparison with the arrangement of FIG. 1, installed on the apparatus of the parent application which is pulled to the top of the column of mud by weight bars and which is used during disassembly of the drill string as the drill pipe is pulled upwardly to the drilling rig; and, FIG. 5 is a view of the wiping cup mounted on the apparatus of FIG. 4.

Attention is first directed to FIG. 1 showing a string of pipe 10. A wireline 11 supports the socket 12 which is threaded to a weight bar 13 and which is connected to a mandrel 14. The mandrel 14 terminates at the bottom in a check valve 15 permitting flow upwardly through the check valve. The valve 15 opens to the exterior at a cage 16.

The mandrel 14 threads to the weight bar 13 at its upper end. It has a passage therethrough which opens at ports (not shown) located above the wiping cup 20. The wiper 20 is carried on the weighted mandrel into a standing column of fluid in the pipe 10. When it reaches the required depth, it is lifted by the wireline 11. The wiping cup 20 flares and contacts the wall of the pipe, thereby supporting the column of fluid above and lifting it out of the well. It lifts and provides a wiping action simultaneously against the wall. It supports the column of fluid and enables it to be lifted to the top.

FIG. 2 shows the wiper 20 in greater detail. The mandrel 14 includes a downwardly facing shoulder 21 which abuts a sleeve 22. The sleeve is slidable about the mandrel. An O-ring 23 provides a seal against the mandrel surface. The sleeve 22 receives a cylindrical tubular resilient body 24 thereabout which is concentric with it. The rubber is preferably bonded to the metal sleeve.

A metal cap 25 having an inwardly directed bottom 26 pinches the resilient material 24 against the sleeve, thereby firmly joining the resilient portion so that it can be supported at the lower end.

The wiping cup includes the lower tubular portion 24 concentric with the sleeve 22 and cup 25. It begins to flare outwardly in a bell-shape beginning at 28. The flared portion 29 extends to a lip 30 which is of reinforced thickness when compared with the flared portion 29. The interior is defined by a wall 32 which is spaced away from the outer surface of the mandrel. There is some small volume on the interior of the flared cup. The lip 30 defines the upper end of the small volume. The volume enables the fluid which is captured by the device to flow under the flared portion 29 and inflate it, forcing the lip 30 into firmer contact with the surrounding pipe wall. Fluid is caught beneath the lip 30 and forces the lip outwardly.

The lip 30 is connected to two or three relatively thin but wide support straps 36. The straps 36 extend from the lip to a ring 38. The ring 38 is bonded to a sleeve 39 which is free to slide on the support mandrel 14, but is limited in travel in one direction by a shoulder 40. The shoulder 40 abuts the bonded slidable spool 39 and permits it to travel away from the body of the wiping cup. The shoulder 40 limits the degree or extent of flaring of the cup. As the cup flares, the lip 30 tends to widen and this pulls on the straps 36. The straps 36 pull the sleeve 39 against the abutting shoulder 40. This provides a limit on flaring or expansion.

The straps 36 provide control of the lip 30 when a constriction in the pipe is encountered. If a constriction is encountered by moving the straps into the constriction, they contract first. They will pull through the constriction and shrink the lip while doing so. They then pull the lip 30 down to a small size. As the lip is pulled to a smaller diameter, it is passed by the constriction. The straps 36 enable the lip to encounter the restriction in the pipe 10 without endangering the lip. This prevents the lip from being turned double.

When the cup encounters an internal upset which approaches from below the lip 30, the restriction will engage the flared portion 29. Since the lip is attached to a flared body, it can enter the restriction and begins to constrict the lip, thereby enabling the lip to pass through the restriction. When this occurs, the straps 36 merely respond to the shrinkage of the lip and perhaps elongate. This will force the spool 39 away from the shoulder 40, but this is contemplated in the slidable assembly of the spool 39 on the mandrel 14.

Attention is next directed to FIG. 4 where the apparatus 52 of the parent disclosure is shown in a drill pipe 50. It includes a knuckle joint 53 which connects with a weight bar 54. An adequate number of weights are added which pull the apparatus into the mud standing in the drill pipe 50. The mud is forced downwardly by the wiping apparatus 52. It is installed inverted in comparison with the arrangement of FIG. 1. This enables it to settle with the weighted tool 52 to the top of the column of mud.

The mud is wiped from the wall of the pipe 50 and is forced downwardly. As described in the parent disclosure, this enables the drill pipe to be pulled joint by joint and disassembled in the derrick without spilling the mud clinging to the wall in the pipe on the drilling platform. The present invention uses the wiping mechanism to force the column of mud downwardly. The downward movement is relative because the pipe 50 is at all times being pulled upwardly.

The wiping apparatus 20 maintains contact with the top of the column of mud. The mud may fill the slight volume beneath the flared portion 29. It functions in the same manner as the apparatus shown in FIG. 2.

Figure 5:
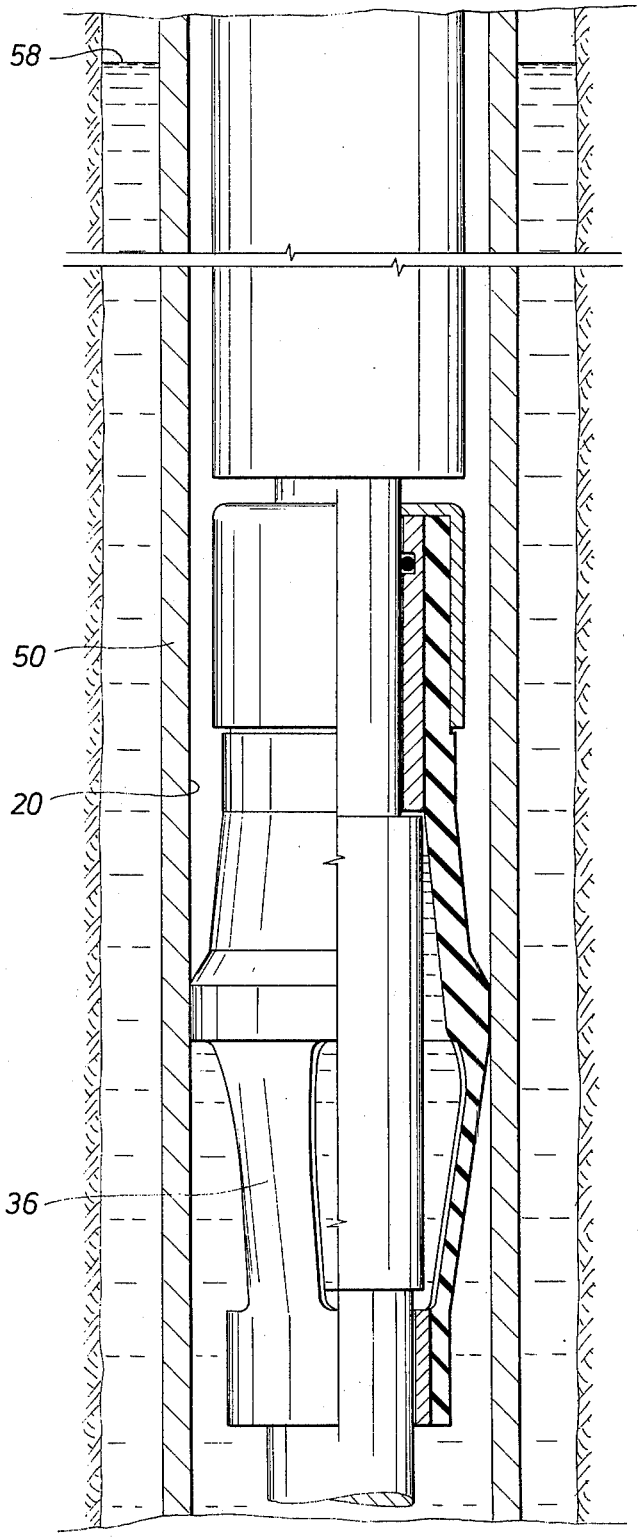

Attention is directed to FIG. 5 where the pipe 50 surrounds the wiping device 20. The apparatus is similar to that shown in FIG. 2 except that it is inverted. It functions in the same manner, particularly when upsets are encountered. The mounting is the same in that the mandrel which supports the wiping cup 20 includes the shoulders arranged in similar manner. The apparatus enables the wiping cup to force mud relatively downwardly in the pipe 50. The mud level is determined by the wiping cup 20. It is forced upwardly in the annulus to a level indicated at 58. The mud flows out of the pipe and stays in the annulus where it serves its intended purpose.

The tool 52 is used to block blow-outs directed up the drill string. When a blow-out occurs, mud will typically be gas cut and become light and frothy. Pressure from the formation is introduced into the drill pipe. This is particularly dangerous when pulling a drill string because at that juncture, the mud line is normally disconnected. The drill string is open at its upper end. The apparatus in the parent disclosure kills blow-outs traveling through the drill string. Blow-out preventers provide external blow-out protection. The new and improved cup of the present invention holds against high pressure blow-outs. In the event of a blow-out, the parent disclosure describes how the tool 52 expands and locks into position, and does not travel upwardly at the urging of downhole pressure differentials. The cup flares when downhole pressure differential occurs. It flares outwardly and seals and holds against downhole pressure. Distortion of the cup is limited by the straps 36 which hold against bottom hole pressure. Even though the cup may flare, it is not inflated to the point where it locks or is damaged. The cup flares and balloons only slightly because it is constrained by the surrounding pipe 50 and held into position by the straps 36. When it balloons or inflates the straps 36 are pulled taut, but they do not extend by a distance greater than that permitted by the shoulder which limits the travel of the ring 38. When pressure is released later, the resilient materials can return to their original shape, dependent on pressure drop.

Many alterations and modifications can be incorporated in the present invention. The scope is determined by the claims which follow.

I claim:

1. An apparatus which is adapted to be incorporated with a body axially movable in a drill pipe with a fluid therein such as drilling fluid or fluid from a downhole formation which fluid tends to cling to the inner wall of the drill pipe and the body is adapted to be moved relatively upwardly or downwardly in the drill pipe to urge an accumulation of fluid in the pipe in a direction determined by the body and the present apparatus is carried into contact with the fluid in a controlled manner, the apparatus comprising an encircling resilient member having an external resilient lip adapted to wipe against the inner wall of the pipe on relative axial movement of said body in the pipe, said member fitting about the body and including integrally joined resilient strap means extending from said lip to an anchor means relatively fixing one end of said strap means and constraining said lip spaced outwardly of said resilient member for wiping movement and wherein said strap means accomodates a limited range of relative flexure of said lip as said lip encounters an internal upset in the drill pipe which requires flexure of said lip and said strap means prevents said lip from lodging and hanging against the upset.

2. The apparatus of claim 1 wherein said resilient lip is flared outwardly from the body to define a volume within said lip which captures fluid having a limited path of escape therefrom and said lip includes an outer surface adapted to contact the inner surface of the pipe and has an inner surface defining said volume, said lip further being attached to a telescoped sleeve-like member around the body.

3. The apparatus of claim 2 wherein said strap means has an outer face which fairs smoothly into said lip to define an outwardly tapered surface which extends at an angle relative to the body for intercepting an internal upset prior to engagement of said lip with the upset such that said strap means pulls said lip into a size and shape enabling it to pass through the internal upset.

4. The apparatus of claim 3 including wherein said anchor means is an encircling slidably mounted ring telescoped about the body, and including a means for limiting axial movement of said ring along the body.

5. The apparatus of claim 4 wherein said last named means includes a pair of spaced shoulders limiting movement of the ring.

6. The apparatus of claim 5 wherein said ring is loosely telescoped about the body and said shoulders are on the body.

7. The apparatus of claim 5 wherein said strap means includes at least three straps at spaced locations on said lip and each is similarly connected to said ring.

8. The apparatus of claim 7 wherein said lip is joined to a telescoped tubular sleeve around the body and is fixed thereto, and further includes means preventing flow of fluid between said tubular sleeve and the body.

9. The apparatus of claim 8 including a means fixing said sleeve to the body.

* * * * *